US005158048A

United States Patent [19]

Robnett et al.

[11] Patent Number: 5,158,048

[45] Date of Patent: Oct. 27, 1992

[54] LOST MOTION ACTUATOR

[75] Inventors: James T. Robnett, Royal Oak; Mark R. Molitor, Spring Lake, both of Mich.

[73] Assignee: Siemens Automotive L.P., Auburn Hills, Mich.

[21] Appl. No.: 862,170

[22] Filed: Apr. 2, 1992

[51] Int. Cl.[5] ..... F01L 1/34; F01L 1/16

[52] U.S. Cl. ..... 123/90.16; 123/90.12; 123/90.49

[58] Field of Search ..... 123/90.12, 90.13, 90.15, 123/90.16, 90.48, 90.49

[56] References Cited

U.S. PATENT DOCUMENTS

| | | | |
|---|---|---|---|
| 4,223,648 | 9/1980 | Pozniak et al. | 123/90.16 |
| 4,671,221 | 6/1987 | Geringer et al. | 123/90.16 |
| 4,892,067 | 1/1990 | Paul et al. | 123/90.16 |
| 4,919,089 | 4/1990 | Fujiyoshi et al. | 123/90.16 |
| 4,977,867 | 12/1990 | Rhoads | 123/90.49 |
| 5,088,458 | 2/1992 | Wakeman et al. | 123/90.49 |
| 5,103,779 | 4/1992 | Hare, Sr. | 123/90.16 |
| 5,113,811 | 5/1992 | Rembold et al. | 123/90.16 |

*Primary Examiner*—E. Rollins Cross
*Assistant Examiner*—Weilun Lo
*Attorney, Agent, or Firm*—Russel C. Wells; George L. Boller

[57] ABSTRACT

A damping mechanism for a lost motion hydraulic actuator utilizes a thin edge orifice in cooperation with a communication passageway between the upper and lower chambers controls the damping of the upper piston on closure. The upper piston is operatively connected to the engine valve of an internal combustion engine. A communication port from the upper chamber to the communication passageway is closed off as the upper piston returns to its normal position forcing the flow of the hydraulic fluid through the thin edge orifice. In this manner the viscosity of the hydraulic fluid does not control the damping of the actuator and the noise factor is substantially reduced.

6 Claims, 2 Drawing Sheets

LOST MOTION ACTUATOR

This invention relates to hydraulic actuators such as may be found in internal combustion engines and more particularly to a lost motion actuator for an electronic valve timing system for internal combustion engines.

BACKGROUND OF INVENTION

One of the many ways to improve engine performance in motor vehicles is by means of electronic controlled valve actuation systems. In these systems, an electronic control unit, ECU, receives signals from several different sensors in the vehicle such as speed, load, temperature, etc., and by means of certain algorithms in the electronic control unit, the optimum time to open and close engine valves is calculated. The optimum time is converted to an electronic signal, either digital or analog, and supplied to a solenoid operated control valve to control the flow of hydraulic fluid in and out of a hydraulic tappet or valve lifter.

U.S. Pat. No. 4,615,306 issued to Russell Wakeman and entitled "Engine Valve Timing Control System" describes a basic engine valve control system wherein the opening and closing of the hydraulic valve lifters creates pressure pulses in the hydraulic fluid to provide a boost pulse to move the lifter to its extreme position. An electronic control unit controls the operation of the solenoid operated valve to add or remove hydraulic fluid from the lifter to create a fluid link in the lifter transferring motion from the timing cam on the camshaft to the engine valve.

U.S. Pat. No. 4,223,648 issued to Pozniak et al and entitled "Hydraulic Valve Lifter" describes a "leakdown" hydraulic lifter wherein a Belleville spring valve disc having a thin, sharp edge orifice that is operative to sense the oil flow rate between the valve chamber 53 and the reservoir chamber 24 to regulate the volume capacity of the pressure chamber and therefore the axial extent of the valve lifter as a function of engine speed. Actual leakage of the fluid due to the fit between adjacent telescoping parts permits the lifter to collapse as the tappet approaches the high point of the timing cam. It is well known that in determining flow through an orifice, as the length of the orifice becomes smaller and smaller, the viscosity factor of the fluid in effect disappears from the equation. This was recognized in the '648 patent. This patent is concerned with the collapse of the lifter at the beginning of the valve motor, thus reducing the duration and is not concerned with the closure of the valve. As the engine gains speed, RPM, the valve mechanism will close faster and the duration will become longer. No lifter can extend during valve motion, unless it actually becomes separated from the cam or rocker arm; this is called float.

SAE Technical Paper #840335 presented at the 1984 SAE International Congress & Exposition by the patentees of the '648 patent also discusses in greater detail the aspects of the variable valve timing lifter.

SUMMARY OF INVENTION

The invention resides in a lost motion hydraulic actuator for use in a bore in the cylinder head of an internal combustion engines. The actuator has a tubular housing member with a shoulder intermediate the ends of the housing for dividing the housing into an upper chamber and a lower chamber. A lower piston is mounted for reciprocal motion in the lower chamber and biased outward of the housing by a first bias spring from the shoulder to the top of the lower piston. An upper piston is mounted for reciprocal motion in the upper chamber and biased outward of the housing by means of a second bias spring. The upper piston in its normal position is located against a second shoulder in the upper chamber. At least one inlet means extends through the wall of the housing for receiving hydraulic fluid into the lower chamber. The actuator has a fluid communication way means intermediate the ends of the housing member between the walls of bore and the outside periphery of the housing member. The communication way intersects the inlet and controls the flow of hydraulic fluid between the chambers. A communication port connects the fluid communication way with the upper chamber with the port being opened and closed by the reciprocal motion of the upper piston. An orifice disk member is mounted on the first shoulder in the upper chamber and biased against the first shoulder by the second bias spring. The disk has a plurality of flow ring passages around its periphery for allowing the flow of hydraulic fluid from the lower chamber to the upper chamber. A thin orifice is centrally located in the orifice disk member for controlling the flow of hydraulic fluid from the upper chamber to the lower chamber when the upper piston closes the communication port to provide damping of the upper piston during the reciprocal movement of the upper piston toward its normal position.

It is an important advantage of the lost motion actuator to provide a hydraulic valve actuator wherein the closing movement of the engine valve as a result of the closing of the actuator is independent of the viscosity of the hydraulic fluid and the programmable timing of the operation of the engine valve which it controls.

It another advantage of the lost motion actuator to control the start of the damping of the closing of the actuator to reduce unwanted oscillations in valve motion during valve closing.

It another advantage of the lost motion actuator to control the start of the damping of the closing of the actuator to reduce the noise of the valve closing.

It is yet still another advantage to control the slope of the valve closing as it approaches the base circle of the timing cam.

It is still another advantage to control the decay time of the closing of the engine valve in a family of actuators.

These and other advantages of the lost motion actuator will be illustrated in the following drawings and detailed description of the lost motion actuator of the present invention.

DETAILED DESCRIPTION

Figure 1:
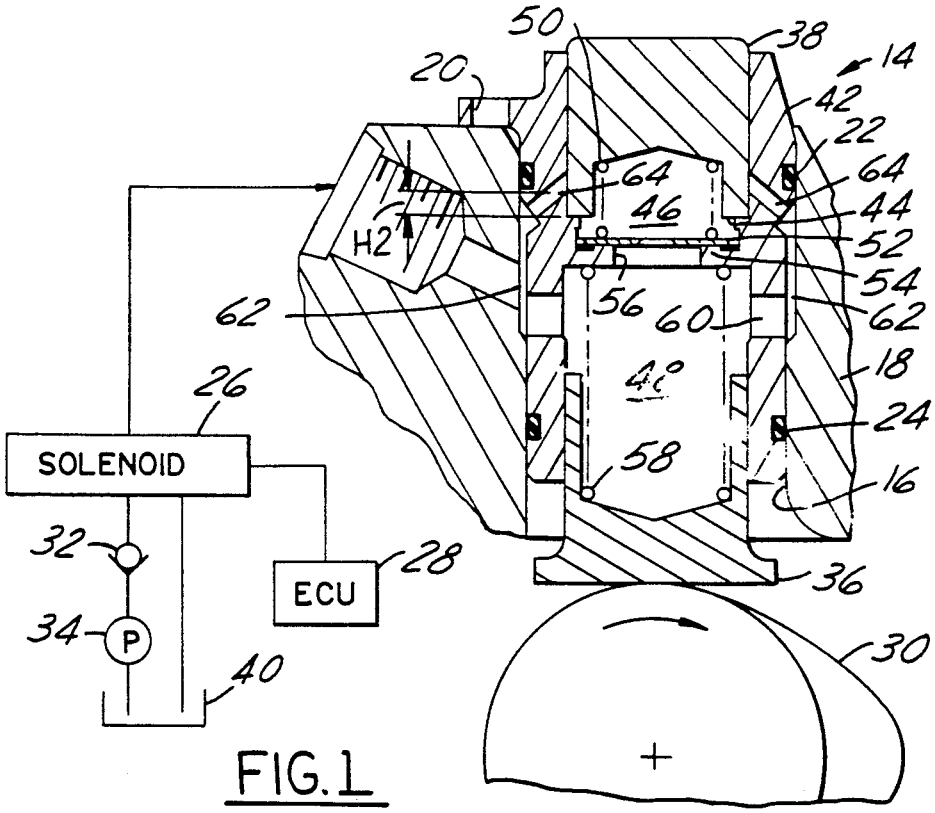
FIG. 1 is a cross-sectional view of the lost motion hydraulic actuator, of the present invention, riding on the base circle of a timing cam.

Referring to the Figures by the characters of reference there is illustrated in FIG. 1 in section, the lost motion hydraulic actuator 14 incorporating the several features of the invention. The fundamental operation of a hydraulic actuator in an internal combustion engine for controlling the opening and closing of the engine valves is well know and will not be detailed here.

The actuator 14 is mounted in a bore 16 in the cylinder head 18 of the engine and is contained there by means of fasteners such as bolts, not shown, passing through clearance holes 20 in the actuator 14 and being threaded into the cylinder head 18. At least two seal members 22, 24 are located around the outside diameter of the actuator 14 to control or prevent leakage of the hydraulic fluid from between the actuator 14 and the bore 16 and into the various volumes in the cylinder head and the engine. The hydraulic fluid in most installations is engine oil. As the temperature of the engine oil changes, from −30° C. to +150°, the viscosity of the engine oil varies over a range of three magnitudes (500 Saybolt Universal Seconds, "SUS", to 5 SUS).

Figure 10:
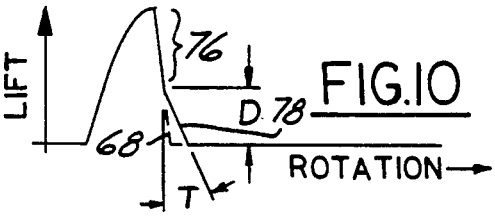
FIG. 10 is a timing diagram illustrating the motion of a engine valve in an electronic valve timing system using the lost motion actuator of the present invention under control of an ECU.

The fluid control of the hydraulic fluid is by means of a solenoid actuated valve 26 controlled by an electronic valve timing control unit or ECU 28. The solenoid actuated valve 26 is operated to control the flow of the hydraulic fluid to and from the actuator 14 in a manner as described in U.S. Pat. No. 4,615,306. This is one of several patents describing an electronic valve timing, EVT, system. While an EVT system can not create more valve motion, it can reduce the valve motion created by the timing cam 30. The EVT system can be programmed to allow standard or full valve lift, as illustrated in FIG. 10, down to zero valve lift in any increment.

As illustrated, a one-way valve 32 controls the flow of fluid from a pump 34 to the cylinder head 18. In its most simplistic operation, when the solenoid valve 6 is opened, the hydraulic fluid flows into the actuator 14 to maintain the proper amount of fluid therein and to maintain the pressure of the fluid. When the solenoid valve 26 is closed, the fluid is trapped in the actuator 14 forming a "solid fluid link" that functions to operate the actuator 14 by having the lower piston 36 solidly connected, by the fluid link, to the upper piston 38 so that both reciprocate together. The upper piston 38 is operatively connected to the engine valve of the engine. Typically the engine valve is biased closed by means of a valve spring which also functions to maintain the upper piston 38 in its normal position as will herein be described. Again, when the solenoid valve 26 is opened the hydraulic fluid, under the pressure of the valve spring, not shown, flows back to the oil supply 40. The ECU 28 receives various signals from several engine sensors, not shown, and according to predetermined conditions controls the operation of the solenoid actuated valve 26.

The upper piston 38 is slideably located for reciprocal motion in a by-pass sleeve 42. In its normal position, the upper piston 38 rests on a shoulder 44 as illustrated in FIG. 1. The by-pass sleeve 42, in cross-section as indicated in FIG. 1, is shaped like an "H" with the upper piston 38 located in an upper chamber 46 above the cross bar of the "H" and the lower piston 36 located in the lower chamber 48 below the cross bar of the "H". Both pistons 36, 38 are located along the vertical axis of the by-pass sleeve 42. In the upper chamber 46 there is located an upper spring 50 which biases the upper piston 38 away from the cross bar. The upper spring 50 is supported at one end by means of an orifice plate 52 resting on a support ring 54 formed in the cross bar and is located against the bottom of a blind bore in the upper piston 38.

Located axially in the cross bar, is a chamber passage 56 allowing the flow of fluid between the upper 46 and lower 48 chambers. In the lower chamber 48, is a lower or tappet spring 58 biasing the lower or tappet piston 36 against the timing cam 30. The timing cam 30 is connected to an engine rotating shaft, typically the engine camshaft, and provides the basic valve opening and closing times for the various engine valves. In a typical engine, there is one cam for each valve and there is at least one intake and one exhaust valve per cylinder. Since this operation is well known, the camshaft and engine are not shown.

Located in and extending through the legs of the "H" shaped by-pass sleeve 42 are at least one inlet means or spaced ports 60 providing passageways for the flow of hydraulic fluid into and out of the lower chamber 48. As illustrated, between the ports 60 and along the outside diameter of the by-pass sleeve 42 and formed between the inner diameter of the bore 16 in the cylinder head 18 and the by-pass sleeve, is a circumferential communication passageway 62 functioning to provide a passageway for the flow of hydraulic fluid from the solenoid actuated valve 26 to the ports 60 and also providing for the flow of fluid between the upper chamber 46 and the lower chamber 48.

Figure 5:
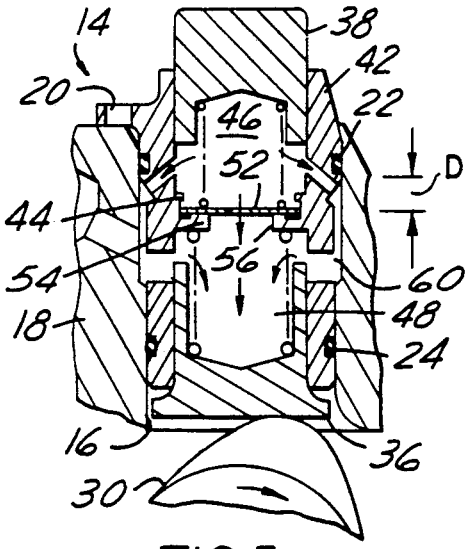

Located near the top end of the communication passageway 60 is a communication port 64 connecting the communication passageway 62 to the upper chamber 46. It is the vertical positioning, "D" as shown in FIGS. 5 and 10, from the end of the communication port 64 to the top of the shoulder 44 in the upper chamber 46 that determines when and where in the valve operation cycle the damping of the lower piston 36 begins. This is further illustrated in FIG. 10.

Figure 2:
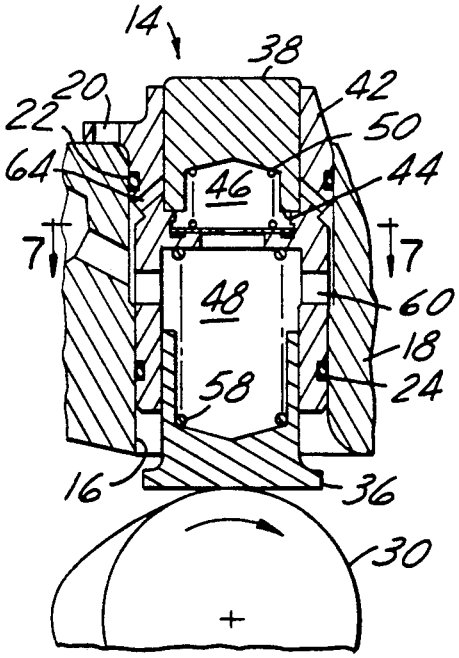
FIGS. 2–6 are cross-sectional views of the hydraulic actuator at various times during the rotation of a timing cam.
Figure 3:
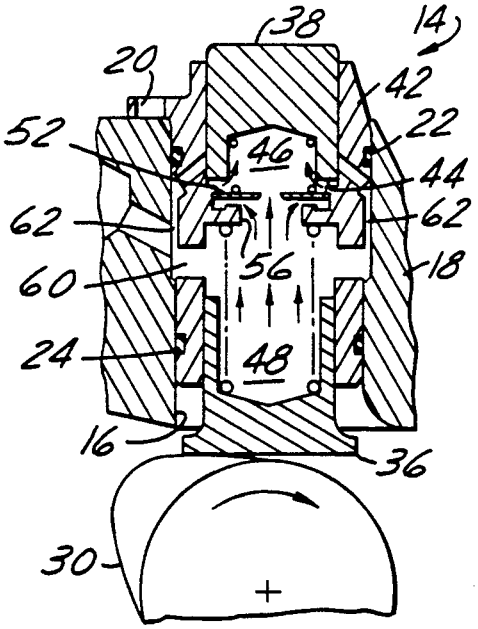
Figure 4:
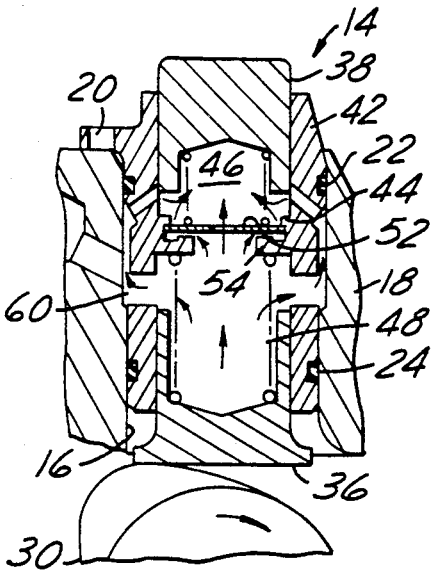
Figure 6:
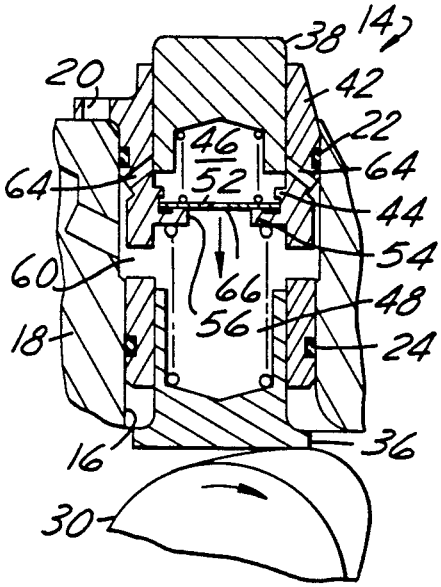
Figure 9:
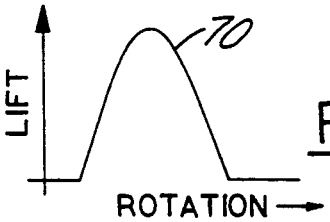
FIG. 9 is a timing diagram illustrating the motion of a engine valve, having a fixed timing cycle, according to the timing cam profile.

FIGS. 2–6 show, respectively, the operation of the lost motion actuator 14. FIG. 2 illustrates zero lift when the lower piston 36 is riding on the base circle of the timing cam 30. In FIGS. 3–6, the flow of the hydraulic fluid within the actuator 14 is illustrated by dashed lines when the solenoid actuated valve 26 is closed and there is no flow of fluid out of the actuator. FIG. 3 illustrates the movement of the pistons 36, 38 as the lower piston 36 rides on the rising portion of the timing cam 30 causing the engine valve to begin to open. FIG. 4 illustrates the movement of the pistons 36, 38 as the lower piston 36 approaches the top of the timing cam 30 and the flow of the hydraulic fluid in the actuator. FIG. 5 illustrates the movement of the pistons as the tappet leaves the top of the timing cam as the engine valve is beginning to close. FIG. 6 illustrates the movement of the pistons 36, 38 as the lower piston 36 approaches the base circle of the timing cam 30. Without the provision of a thin sharp edge orifice 66 in the orifice plate 52 and the communication port 64 from the upper chamber 46 to the communication way 62, the actuator 14 movement would be very similar to that illustrated by the dashed lines 68 in FIG. 10. FIG. 9 illustrates the standard lift profile 70 of an engine valve unmodified by EVT. In both FIGS. 9 and 10, the abscissa is the angle of rotation of the timing camshaft and ordinate is the amount of lift or opening of the engine valve.

Figure 7:
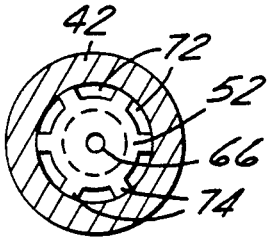
FIG. 7 is a sectional view taken along line 7—7 of FIG. 2 showing thin disc orifice plate.
Figure 8:
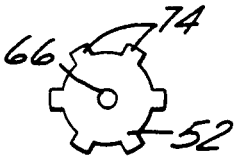
FIG. 8 is a plan view of the thin disc orifice plate.

Referring to FIG. 3, the fluid flows from the lower chamber 48 through the chamber passage 56 and from there in parallel through the orifice 66 and the flow ring passages 72 between the locating lugs 74 on the orifice plate. FIGS. 7 and 8 show in greater detail the flow ring passages 72 and locating lugs 74 on the orifice plate 52. The pressure of the fluid being "pumped" by the lower piston 36 causes the orifice plate 52 to lift off of the support ring 54 allowing the fluid to flow from the chamber passage 56 through the flow ring passages 72 between the locating lugs 74 of the orifice plate 52.

Referring to FIG. 4, the upper piston 38 has been lifted at least a distance "D" and is clear of the bottom of the communication ports 64 in the by-pass sleeve 42. The hydraulic fluid can now flow out of the inlet ports 60, through the communication passageway 62 and into the upper chamber 46. This increases the size of the flow routes and therefore increases the amount of fluid flowing from the lower chamber 48 to the upper chamber 46. This is an improvement over previous designs of actuators in that the parasitic losses from the actuator are reduced. The result is a faster rise of the upper piston 38 and the hence the opening of the engine valve.

FIGS. 5 and 6 illustrate the flow of the hydraulic fluid from the decreasing volume of the upper chamber 46 to the expanding volume of the lower chamber 48 as the engine valve closes. Until the upper piston 38 slides down to the top of the communication ports 64, the fluid flows both through the orifice 66 and through the communication ports 64 and communication passageway 62. The pressure of the fluid causes the orifice plate 52 to seat on the support ring 54 on the cross bar of the by-pass sleeve 42. As the upper piston 38 begins to close off the communication ports 64, the flow of the fluid lessens and the damping action of the upper piston 38 begins. This is illustrated in FIG. 10, wherein the solenoid actuated valve 26 is opened and the fluid can be pushed out of the actuator 14 to allow the upper piston 38 to return to its normal position as illustrated in FIG. 1. The effect of this opening is illustrated by the almost vertical descent 76 of the profile curve parallel to the ordinate. FIG. 10 illustrates the relationship of the height "D" of the communication ports 64 above the shoulder 44 and the beginning of the damping slope 78 of the closure of the engine valve.

Figure 11:
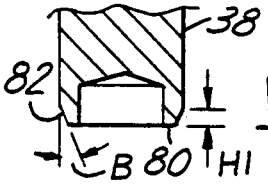
FIG. 11 is another embodiment of the upper or damping piston.

Referring to FIG. 11, there is illustrated an alternate embodiment of the upper piston 38. In high speed operation, camshaft speeds, >3500 RPM, the leading edge 80 of the upper piston 38 must be relieved by relief means 82 such as a chamfer having an angle "B" and an axial height of "H1". In lieu of a chamfer, the leading edge 80 may be undercut by means of a stepped surface, not shown. The relationship between the angle "B" and the axial height "H1" is provide a gradual initiation of the damping function as the upper piston 38 covers the communication ports 64. The axial height "H1" on the leading edge 80 of the upper piston 38 is less than the distance "H2", in FIG. 1, from the bottom of the communication ports 64 above the shoulder 44 in the by-pass sleeve 42. As the upper piston 38 begins to close off the communication ports 64, the chamfer 82 allows gradual closing off the fluid flow and hence reduces the pressure pulsations do to abrupt closing the communication ports 64. Unwanted pressure pulsations, similar to hydraulic hammer when a flow port is closed very rapidly, operate to provide deviations in valve lift.

The size of the orifice 66 determines the amount of flow of the fluid from the upper chamber 46 to the lower chamber 48 and hence the total time "T" of damping including controlling the slope 78 of the curve of FIG. 10 approaching the base circle. It is well known that as the length of the orifice 66, or the thickness of the orifice plate in the area of the orifice, approaches a thin sharp edge, the viscosity term in the equation for determining the flow of the fluid "falls out" of the equation. It is for this reason that with the orifice plate 52 being of a predetermined thickness to support the upper spring 50 and to move off of the support ring 54 during the opening of the actuator 14 as illustrated in FIGS. 3 and 4, the surface of the orifice plate 52 around the orifice 66 is chamfered to reduce the length of the orifice 66 so as to present a thin sharp edge to the flow of the fluid from the upper chamber 46 to the lower chamber 48. As illustrated the chamfer or bevelled edge is on the surface of orifice disk member 52 facing the lower chamber 48.

It is to be understood, that under the control of the ECU 28 the slope of the valve operation as illustrated in FIGS. 9 and 10 may take many different shapes. However, once the solenoid valve 26 is opened and the fluid flows out of the actuator 14 for a substantial period of time indicating that the valve will be closed, the cooperation between the communication ports 64, the bottom or leading edge 80 of the upper piston 38 and the size of the orifice 66 will control the beginning of the damping slope, "D" in FIG. 10 and the decay time or angle "A" as the engine valve approaches and seats in its valve seat.

What is claimed is

1. A lost motion hydraulic actuator for use in a bore in the cylinder head of an internal combustion engines having a tubular housing member, a shoulder intermediate the ends of the housing dividing the housing into an upper chamber and a lower chamber, a lower piston mounted for reciprocal motion in the lower chamber and biased outward by a first bias spring from the shoulder to the piston, an upper piston mounted for reciprocal motion in the upper chamber and biased outward by means of a second bias spring, a second shoulder in the upper chamber for locating the upper piston in its normal position, at least one inlet means through the housing for receiving hydraulic fluid into the lower chamber, the actuator characterized in that a fluid communication way means intermediate the ends of the housing member between the walls of the bore and the outside periphery of the housing member, said communication way intersecting the inlet and controlling the flow of hydraulic fluid between the chambers, a communication port connecting said fluid communication way with the upper chamber, said port being opened and closed by the reciprocal motion of the upper piston, and an orifice disk member mounted on the first shoulder in the upper chamber and biased against the first shoulder by the second bias spring, said disk having a plurality of flow ring passages around the periphery of said disk for allowing flow of hydraulic fluid from the lower chamber to the upper chamber, and a thin orifice centrally located in said orifice disk member for controlling the flow of hydraulic fluid from the upper chamber to the lower chamber when the upper piston closes said communication port providing damping of the upper piston during the reciprocal movement of the upper piston toward its normal position.

2. A lost motion hydraulic actuator for use in a bore in the cylinder head of an internal combustion engines according to claim 1 wherein the upper piston has relief means on the leading edge thereof, said relief means: for gradually closing said communication port during damping of the upper piston.

3. A lost motion hydraulic actuator for use in a bore in the cylinder head of an internal combustion engines according to claim 2 wherein said relief means is a chamfer wherein the axial length of chamfer determines the beginning of damping relative to the normal position of the upper piston.

4. A lost motion hydraulic actuator for use in a bore in the cylinder head of an internal combustion engines according to claim 1 wherein the height of the bottom of the communication port above the second shoulder determines the beginning of damping and the size of said orifice determines the total time of damping irrespective of the viscosity of the hydraulic fluid.

5. A lost motion hydraulic actuator for use in a bore in the cylinder head of an internal combustion engines according to claim 1 wherein said orifice disk member is of a predetermined thickness and the surface around the orifice is chamfered to reduce the length of said orifice to produce a thin sharp edge to said orifice.

6. A lost motion hydraulic actuator for use in a bore in the cylinder head of an internal combustion engines according to claim 5 wherein said chamfer is on the side of said orifice disk member facing the lower chamber.

* * * * *